US007032575B2

(12) United States Patent
Sims, Jr.

(10) Patent No.: US 7,032,575 B2
(45) Date of Patent: Apr. 25, 2006

(54) VALVE ASSEMBLY FOR A FUEL PUMP MODULE

(75) Inventor: Dewey McKinley Sims, Jr., Wayne, MI (US)

(73) Assignee: Robert Bosch Corporation, Broadview, IL (US)

( * ) Notice: Subject to any disclaimer, the term of this patent is extended or adjusted under 35 U.S.C. 154(b) by 21 days.

(21) Appl. No.: 10/620,950

(22) Filed: Jul. 16, 2003

(65) Prior Publication Data

US 2005/0011559 A1 Jan. 20, 2005

(51) Int. Cl.
*F02M 37/04* (2006.01)

(52) U.S. Cl. ..... 123/509; 123/514; 137/534

(58) Field of Classification Search ..... 123/509, 123/514, 495; 137/860, 532, 534, 534 X, 137/516.5, 512.5
See application file for complete search history.

(56) References Cited

U.S. PATENT DOCUMENTS

| | | | | | |
|---|---|---|---|---|---|
| 550,730 | A | * | 12/1895 | Stone | 137/516.15 |
| 793,214 | A | * | 6/1905 | Neuhaus | 137/516.15 |
| 1,072,004 | A | | 9/1913 | Hart | |
| 1,138,551 | A | | 5/1915 | Gebhardt | |
| 1,737,588 | A | | 12/1929 | Hopkins et al. | |
| 2,506,306 | A | * | 5/1950 | Mantle | 137/516.15 |
| 2,935,075 | A | | 5/1960 | Ringer | |
| 4,188,174 | A | * | 2/1980 | Perkins | 417/432 |
| 4,545,400 | A | * | 10/1985 | Gruber et al. | 137/467 |
| 4,971,017 | A | * | 11/1990 | Beakley et al. | 123/510 |
| 5,070,849 | A | * | 12/1991 | Rich et al. | 123/509 |
| 5,363,827 | A | * | 11/1994 | Siekmann | 123/509 |
| 5,520,209 | A | * | 5/1996 | Goins et al. | 137/246 |
| RE35,532 | E | * | 6/1997 | Duren | 137/526 |
| 5,647,330 | A | * | 7/1997 | Sawert et al. | 123/509 |
| 5,787,865 | A | * | 8/1998 | Harris et al. | 123/516 |
| 6,123,511 | A | * | 9/2000 | Sertier | 417/87 |
| 6,283,142 | B1 | | 9/2001 | Wheeler et al. | |
| 6,371,153 | B1 | | 4/2002 | Fischerkeller et al. | |
| 6,436,287 | B1 | | 8/2002 | Fischerkeller et al. | |
| 6,457,459 | B1 | | 10/2002 | Schelhas et al. | |
| 6,640,789 | B1 | * | 11/2003 | Gabauer et al. | 123/509 |

* cited by examiner

*Primary Examiner*—Carl S. Miller
(74) *Attorney, Agent, or Firm*—Michael Best & Friedrich LLP

(57) ABSTRACT

A fuel pump module includes a reservoir configured to hold a supply of fuel. The reservoir includes a fuel passageway and defines a first seat on a first side of the fuel passageway and a second seat on a second side of the fuel passageway. The module also includes a seal configured to be seated on the first and second seats to substantially seal the fuel passageway, and a weight biasing the seal toward the first and second seats by contacting the seal only at a location between the first and second seats. A gap may be defined between the weight and the seal, allowing fuel to enter the gap and further bias the seal toward the seats.

38 Claims, 7 Drawing Sheets

VALVE ASSEMBLY FOR A FUEL PUMP MODULE

FIELD OF THE INVENTION

The invention relates generally to fuel systems for internal combustion engines, and more specifically to fuel pump modules that supply fuel to an internal combustion engine.

BACKGROUND OF THE INVENTION

The use of fuel pump modules to pump fuel from fuel tanks is well known in the automotive industry. A typical fuel pump module may include, for example, a fuel reservoir, a fuel pump within the fuel reservoir, a fuel level sensor, one or more filters positioned upstream of the pump inlet, an in-line fuel filter positioned downstream of the pump outlet, and a pressure regulator. The fuel pump module typically rests on the bottom of the fuel tank and pumps fuel from the tank until the tank is substantially empty.

During operation of the fuel pump, the reservoir is continually being filled to ensure that a steady supply of fuel is available to the fuel pump at all times during operation of the pump. Normally, fuel is drawn into the reservoir from the fuel tank by the fuel pump. In the case that the fuel level in the fuel tank is low, or vehicle maneuvering causes the fuel to slosh inside the fuel tank such that the fuel pump inlet cannot draw fuel from the bottom of the tank, the fuel pump is able to draw fuel from within the reservoir. This allows for substantially uninterrupted operation of the fuel pump, in that the fuel pump is substantially prevented from "running dry" and causing unwanted cycling of the fuel pressure to the engine.

Conventional fuel pump modules typically utilize a valve assembly, sometimes referred to as a discriminator valve, that is designed, in part, to prevent the fuel accumulated in the reservoir from draining back into the fuel tank when the fuel pump is not operating. A conventional fuel pump module, having a conventional discriminator valve, is shown and described in more detail below.

SUMMARY OF THE INVENTION

Prior art discriminator valves may not properly seal the reservoir as intended, thus allowing fuel accumulated in the reservoir to leak past the valve assembly and drain back to the fuel tank. With this occurrence, the fuel pump may operate without an initial supply of fuel at start-up, thus potentially causing the pump to overheat, or potentially causing the fuel pump inlet to become uncovered such that the fuel pump has to "run dry" in the beginning moments of operation before fuel once again submerges the fuel pump inlet.

The invention provides an improved discriminator valve assembly that increases the retention of fuel in the reservoir. More specifically, the invention provides a fuel pump module including a reservoir configured to hold a supply of fuel. The reservoir includes a fuel passageway and defines a first seat on a first side of the fuel passageway and a second seat on a second side of the fuel passageway. The fuel pump module also includes a seal configured to be seated on the first and second seats to substantially seal the fuel passageway. Further, the fuel pump module includes a weight biasing the seal toward the first and second seats by contacting the seal only at a location between the first and second seats.

In one construction of the invention, the first and second seats are substantially annular, the seal is a substantially flat, annular disk, and the weight is substantially annular. In another construction of the invention, the weight includes a substantially convex surface at least partially in contact with the seal.

The invention also provides a fuel pump module having a weight that is configured to provide a gap between a lower surface of the weight and an upper surface of the seal. Fuel enters the gap and helps bias the seal toward the first and second seats. In one construction, the gap includes a first gap located adjacent the first seat and a second gap located adjacent the second seat.

Further, the invention provides a method for maintaining fuel within a fuel pump module. The method includes providing a reservoir having a fuel passageway and defining a first seat on a first side of the fuel passageway and a second seat on a second side of the fuel passageway, and biasing a seal toward the first and second seats to substantially seal the fuel passageway even when the first and second seats are not properly aligned. In one construction, the method further includes deflecting the seal in an area between the first and second seats to ensure contact between the seal and the first seat, and the seal and the second seat.

The invention also provides another method for maintaining fuel within a fuel pump module. The method includes providing a gap between a lower surface of a weight and an upper surface of the seal. In one construction, the method further includes allowing fuel to enter the gap to bias the seal toward the first and second seats. In another construction, providing the gap includes providing a first gap adjacent the first seat and providing a second gap adjacent the second seat.

Other features of the invention will become apparent to those skilled in the art upon review of the following detailed description, claims, and drawings.

Figure 1:
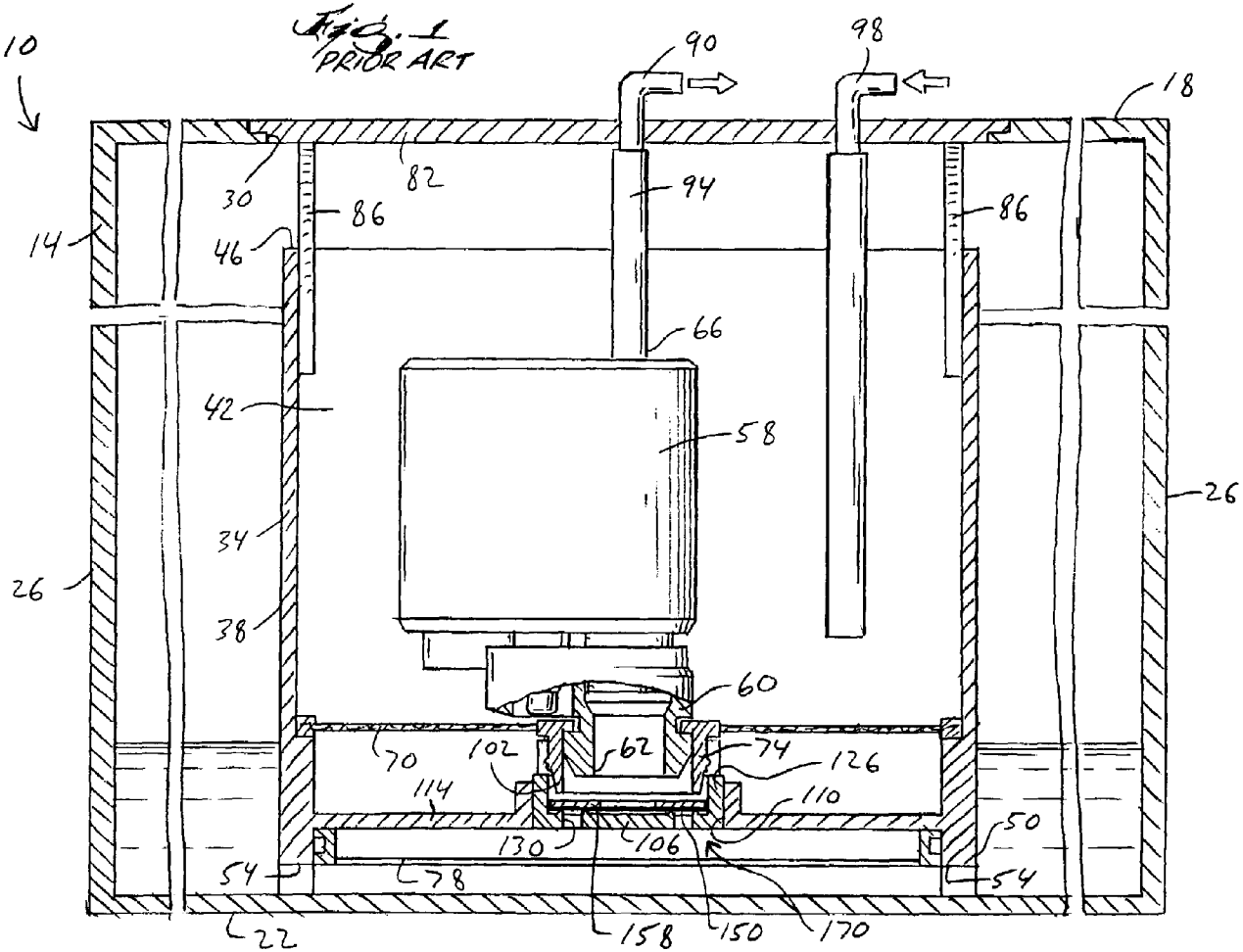
Fig. 1 PRIOR ART
FIG. 1 is a cross-sectional view of a prior-art fuel pump module shown inside a fuel tank.

Before any features of the invention are explained in detail, it is to be understood that the invention is not limited in its application to the details of construction and the arrangements of the components set forth in the following description or illustrated in the drawings. The invention is capable of other constructions and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION

FIG. 1 illustrates a prior-art fuel pump module 10 for use in conjunction with an internal combustion engine (not shown). It should be understood that most of the components associated with the prior-art fuel pump module 10 may also be associated with a preferred construction of the present invention. All of the components of the fuel pump module 10 described below can be made of any suitable fuel resistant materials, such as fuel resistant conductive plastics. The use of conductive plastics also helps reduce and/or eliminate electrostatic charges that tend to build up in the fuel tank environment.

The fuel pump module 10 can be inserted into a fuel tank 14 having a top wall 18, a bottom wall 22, and four side walls 26 (only two are shown). The top wall 18 includes an opening 30 through which the fuel pump module 10 is inserted into the tank 14. The opening 30 is preferably circular, but can also be various other shapes.

The fuel pump module 10 includes a reservoir 34 sized to fit through the opening 30. The reservoir 34 is substantially cylindrical and has an outer wall 38 that defines an interior portion 42 for housing fuel and other fuel pump module components, as is commonly understood. The outer wall 38 has respective upper and lower ends 46, 50. The reservoir 34 is open on the upper end 46 and includes a reservoir inlet 54 on the lower end 50. The reservoir 34 can be made by injection molding or any other suitable plastic forming technique.

Further included in the fuel pump module 10 is a fuel pump 58 that communicates with the reservoir inlet 54 and the interior portion 42 to pump fuel. The fuel pump 58 includes an inlet end 60 having a fuel inlet 62 that selectively receives fuel from either the tank 14 or the interior portion 42 of the reservoir 34, and a fuel outlet 66 where fuel exits the fuel pump 58. As shown in FIG. 1, the fuel pump 58 is supported in the reservoir 34 by an upper filter plate 70. The upper filter plate 70 is formed as a liquid-permeable membrane, and is supported within the interior portion 42 of the reservoir 34 by known and conventional methods. Of course, other filter plate configurations and other fuel pump supporting mechanisms can also be used. The upper filter plate 70 includes a substantially annular connecting portion 74 engageable with the substantially annular inlet end 60 of the fuel pump 58. In the illustrated construction, a snap-fit connection is utilized to interconnect the inlet end 60 and the connecting portion 74 of the upper filter plate 70. However, in other constructions of the fuel pump module, the inlet end may be coupled to the upper filter plate by any of a number of different methods, including a threaded connection, for example.

A lower filter plate 78 filters fuel just before it is received by the fuel inlet 62 of the fuel pump 58. In the illustrated construction, the lower filter plate 78 is formed as a liquid-permeable membrane. However, the lower filter plate 78 can be of any other known configuration. The fuel pump module 10 may also include a fuel level sensor assembly (not shown) coupled to the reservoir 34. The fuel level sensor assembly provides a measure of the amount of fuel present in the tank 14, as is commonly understood. It should be noted, however, that the use of a fuel level sensing device or any particular type of fuel level sensing device is not critical to the present invention.

The fuel pump module 10 further includes a flange 82 supported above the upper end 46 of the reservoir 34 by support members 86. The flange 82 is the same shape, preferably circular, as the opening 30 in the top wall 18 of the tank 14 so that the flange 82 closes and seals the opening 30 when the fuel pump module 10 is fully inserted. The flange 82 includes an electrical connector (not shown) for providing electrical power to the fuel pump 58. The electrical connector also provides for communication between the engine control unit (not shown), the fuel pump 58, and the fuel level sensor assembly. The flange 82 further includes an outlet port 90 that is fluidly connected with the fuel outlet 66 of the fuel pump 58 by a conduit 94. The outlet port 90 allows fuel to exit the fuel tank 14 and enter the external portion of the fuel system. The flange 82 also includes an inlet port 98 that allows unused fuel to be returned to the fuel tank 14 by, for example, a conventional fuel return line (not shown). As shown in FIG. 1, the inlet port 98 is positioned in the flange 82 such that the returning unused fuel is deposited in the reservoir 34.

Figure 2:
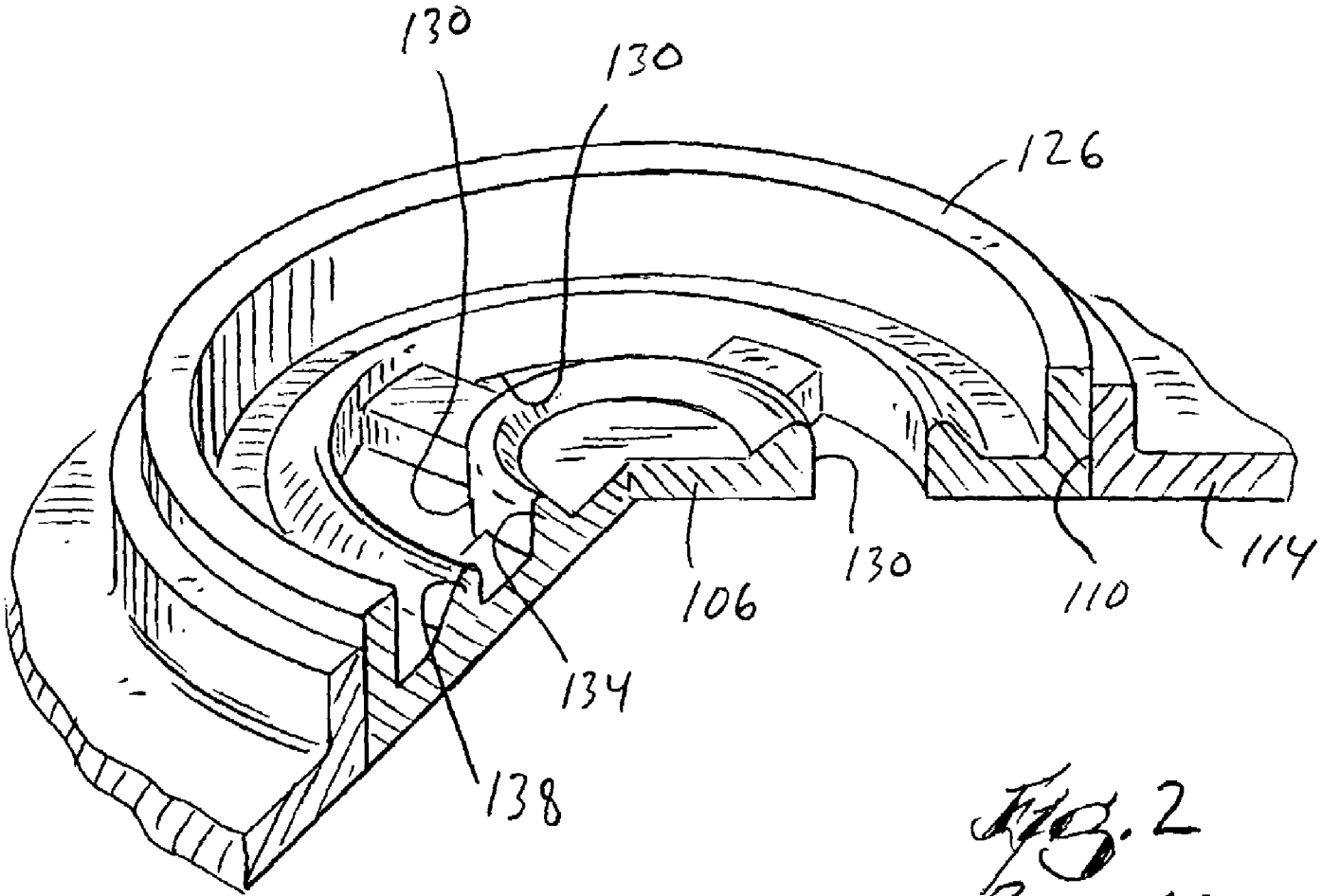
FIG. 2 PRIOR ART
FIG. 2 is a perspective view, partially broken away, of a portion of the reservoir of the fuel pump module of FIG. 1, illustrating multiple fuel passageways therethrough.
Figure 3:
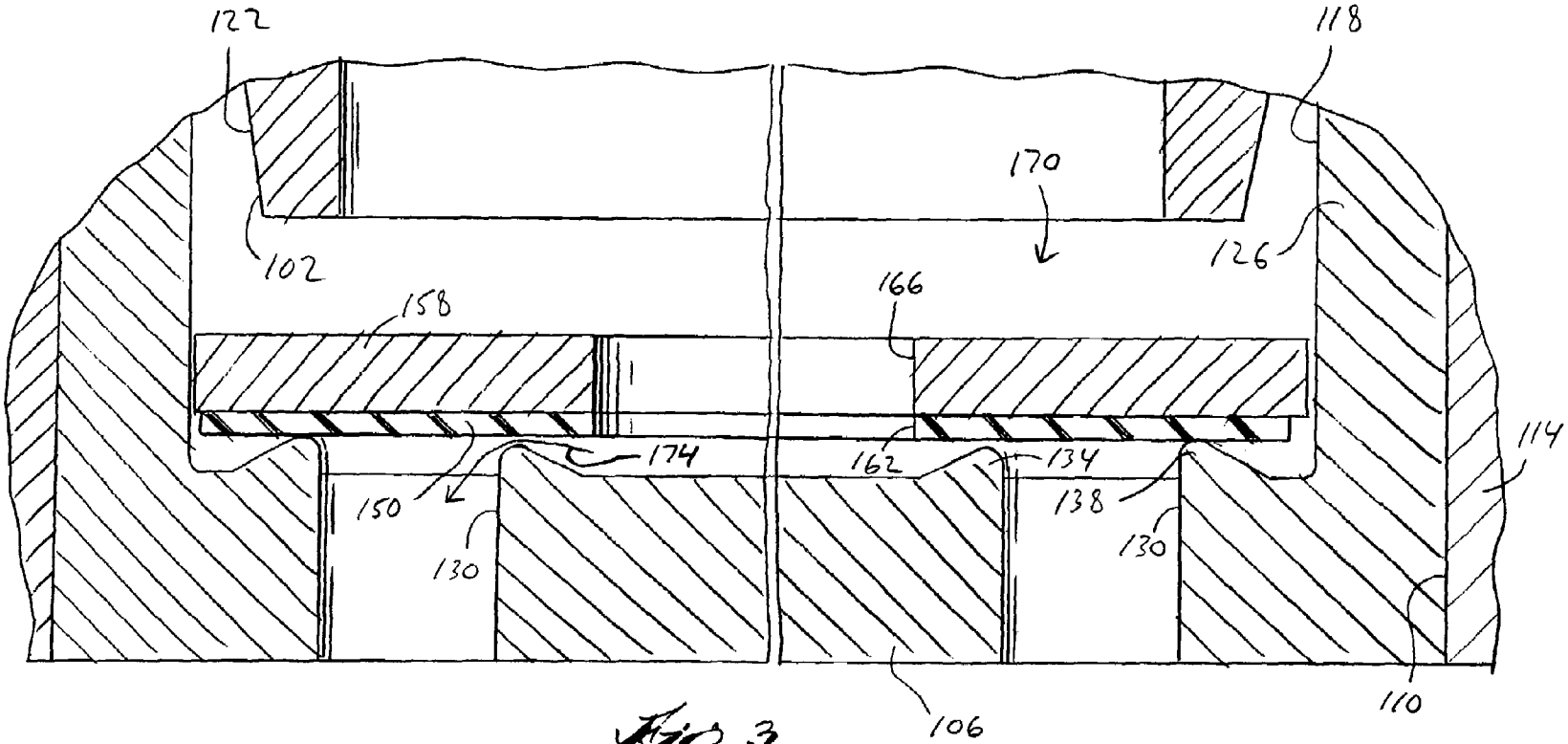
FIG. 3 PRIOR ART
FIG. 3 is an enlarged, partial cross-sectional view of the fuel pump module of FIG. 1, illustrating an improper seal between a conventional discriminator valve and the fuel passageways.

The connecting portion 74 of the upper filter plate 70 includes a lower tapered end 102 extending below the fuel inlet 62 of the fuel pump 58. The lower tapered end 102 of the connecting portion 74 is positioned partially within a valve seat member 106 supported by the reservoir 34. As shown in FIGS. 1 and 2, the valve seat member 106 is inserted within an opening 110 in a plate portion 114 of the reservoir 34. The valve seat member 106 is coupled to the plate portion 114 of the reservoir 34 by known and conventional methods, such as a press-fit or an interference fit. Alternatively, the valve seat member 106 may be integrally formed with the plate portion 114 of the reservoir 34. As best seen in FIG. 3, a substantially annular opening 118 is defined between an outer surface 122 of the lower tapered end 102 and a substantially annular, upstanding wall 126 of the valve seat member 106. The opening 118 allows fuel to enter the valve seat member 106 from the interior portion 42 of the reservoir 34, as will be described in more detail below.

The fuel pump 58 is coupled to the reservoir 34 such that the fuel pump 58 can receive fuel from the fuel tank 14 via multiple fuel passageways 130 formed in the valve seat member 106. In the illustrated construction (see FIG. 2), four fuel passageways 130 are formed in the valve seat member 106 (only three shown in FIG. 2). However, in other constructions of the fuel pump module (not shown), more or fewer than four fuel passageways 130 may be formed in the valve seat member 106. Also, the fuel passageways 130 may be sized accordingly to satisfy various design requirements, such as, for example, the fuel flow rate into the fuel inlet 62 of the fuel pump 58.

With reference to FIGS. 2 and 3, the valve seat member 106 includes a first or inner seat 134 extending around a radially inner perimeter of the fuel passageways 130, and a second or outer seat 138 extending around a radially outer perimeter of the fuel passageways 130. The inner and outer seats 134, 138 are substantially annular and concentric with each other. In the illustrated construction, the inner and outer seats 134, 138 include substantially curved and blunted contours, however, the inner and outer seats 134, 138 can be configured to have any number of different seating contours, including substantially flat contours, ribbed contours, or pointed contours.

Referring to FIG. 3, a substantially flat, annular seal 150 is configured to seat against the inner and outer seats 134, 138 to substantially seal the fuel passageways 130. However, as will be discussed in greater detail below, the seal 150 as illustrated in FIG. 3 is not properly seated against the inner and outer seats 134, 138. The seal 150 is made from an elastomeric material that is also fuel-resistant so that the seal 150 can resist degradation by surrounding fuel. A weight in the form of a flat washer 158 is configured to bias the seal 150 against the inner and outer seats 134, 138, such that fuel is not allowed to flow through the fuel passageways 130. An aperture 162 in the seal 150 and an aperture 166 in the flat washer 158 are sized to provide the fuel inlet 62 with a desired fuel flow rate. The flat washer 158 is made from metal, preferably a corrosion-resistant metal, and is sized to provide a desired weight to bias the seal 150 against the inner and outer seats 134, 138. Together, the valve seat member 106, the seal 150, and the flat washer 158 define a prior art discriminator valve assembly 170.

During operation of a vehicle utilizing the prior art discriminator valve assembly 170, when there is a sufficient level of fuel in the fuel tank 14, the fuel pump 58 draws fuel from the fuel tank 14 through the reservoir inlet 54. In this situation, the ingress of fuel into the fuel inlet 62 overcomes the downward bias of the flat washer 158 and lifts and unseats the seal 150 from the inner and outer seats 134, 138. The upward movement of the flat washer 158 and seal 150 is limited by the lower tapered end 102 of the connecting portion 74. Fuel is therefore allowed to enter the reservoir 34 via the reservoir inlet 54, pass through the lower filter plate 78, through the fuel passageways 130, through the apertures 162, 166 in the seal 150 and the washer 158, and into the fuel inlet 62 of the fuel pump 58.

Also, during operation of the vehicle, the reservoir 34 is continually being filled by return fuel entering via the inlet port 98. Alternatively, for returnless fuel systems, the reservoir 34 may be continually filled by a separate jet pump assembly (not shown). As previously stated, while the fuel pump 58 is drawing fuel from the fuel tank 14, the flat washer 158 is maintained against the lower tapered end 102 of the connecting portion 74. As a result, the substantially annular opening 118 between the upstanding wall 126 of the valve seat member 106 and the lower tapered end 102 is substantially blocked by the washer 158 and the seal 150 such that fuel may accumulate in the reservoir 34 and even spill over the upper end 46 of the reservoir 34. Since the opening 118 is substantially blocked, little or no fuel is drawn from the interior portion 42 of the reservoir 34 into the fuel inlet 62 of the fuel pump 58.

When there is an insufficient amount of fuel in the fuel tank 14 or the fuel is not available at the reservoir inlet 54 due to vehicle maneuvering, the fuel pump 58 draws fuel from the interior portion 42 of the reservoir 34. This occurs when the ingress of fuel through the fuel passageways 130 is interrupted, causing the weight of the flat washer 158 to bias the seal 150 against the inner and outer seats 134, 138, thereby blocking the fuel passageways 130. At the same time, the opening 118 between the upstanding wall 126 of the valve seat member 106 and the lower tapered end 102 is uncovered by the downwardly moving washer 158, thereby allowing fuel from the interior portion 42 of the reservoir 34 to flow through the opening 118, into the valve seat member 106, and into the fuel inlet 62 of the fuel pump 58.

During periods between operation of the vehicle, when the fuel pump 58 is not active, the washer 158 biases the seal 150 against the seats 134, 138 to block the fuel passageways 130 to substantially maintain the level of fuel accumulated in the reservoir 34. However, if the seal 150 does not seat properly against the inner seat 134 and the outer seat 138, the fuel accumulated in the reservoir 34 can leak back into the fuel tank 14 through the fuel passageways 130. During periods of low fuel levels in the tank 14 and/or when the vehicle is parked on a slope so that fuel in the tank 14 is not readily available to the reservoir inlet 54, the fuel pump 58 can loose its prime of fuel. As a result, starting the engine may be problematic.

As shown in FIG. 3, such a situation in which the seal 150 may not seal properly against the inner and outer seats 134, 138 occurs when the inner and outer seats 134, 138 are not aligned or co-planar. FIG. 3 illustrates the inner seat 134 being substantially below the level of the outer seat 138, thereby defining a leakage path (indicated by arrow 174) between the inner seat 134 and the seal 150. Fuel accumulated in the reservoir 34 may flow through this leakage path 174 back into the fuel tank 14, eventually depleting the supply of fuel from the reservoir 34. Of course, the leakage path 174 could alternatively occur between the outer seat 138 and the seal 150 in the case where the outer seat 138 is below the inner seat 134. Such differences in height between the inner and outer seats 134, 138 may result from tolerance stack-ups during manufacturing of the valve seat member 106.

The present invention provides an improved fuel pump module having many of the same components associated with the prior art fuel pump module 10 (e.g., the reservoir 34, the pump 58, the flange 82, etc.), with like components given like reference numerals. However, the improved fuel pump module of the present invention includes an improved discriminator valve assembly 178 that reduces or eliminates the leakage paths 174 that may occur using prior art discriminator valve assemblies 170 like those shown in FIGS. 1 and 3.

Figure 4:
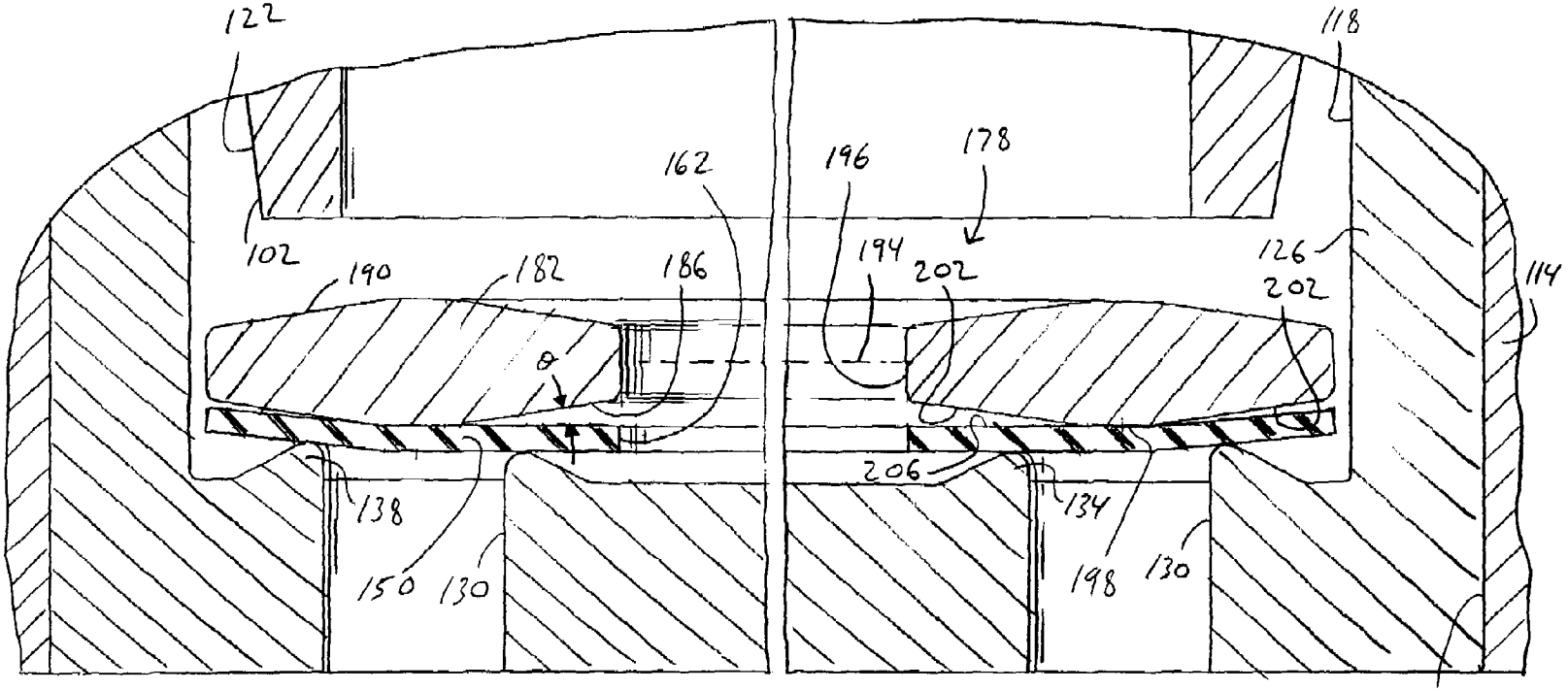
FIG. 4 is an enlarged, partial cross-sectional view of a fuel pump module of the present invention, illustrating a discriminator valve sealing the fuel passageways.

With reference to FIG. 4, a weight 182 in the form of a substantially annular member having oppositely-facing, substantially convex surfaces 186, 190 is shown in combination with the seal 150. As used herein and in the appended claims, the term "convex," as used to describe the surfaces of the weight 182, is not meant to imply any particular surface profile, but rather is intended to describe a surface that is not planar, and that at least partially projects away from a centerline passing through the weight 182, such as the centerline 194 shown in FIG. 4. The weight 182 can be utilized in the same fuel pump module 10 of FIG. 1 to replace the conventional flat washer 158 shown in FIGS. 1 and 3. The weight 182 is made from metal, preferably a corrosion-resistant metal, and is sized and configured to provide a desired weight to bias the seal 150 against the inner and outer seats 134, 138, even when the inner and outer seats 134, 138 are not aligned or co-planar. An aperture 196 in the weight 182 is sized to provide the fuel inlet 62 with a desired fuel flow rate. The weight 182 is shaped to have an equal weight as the conventional flat washer 158 so to not alter the performance of the discriminator valve assembly 178.

The weight 182 is configured to contact the seal 150 only at a location between the inner and outer seats 134, 138. With this concentration of the weight 182 on the seal 150 at a location between the seats 134, 138, the resilient seal 150 is deflected, thereby conforming the seal 150 to any height irregularities between the inner and outer seats 134, 138. Sealing of the fuel passageways 130, even when there are height irregularities between the inner and outer seats 134, 138, is improved. It is important to note that the deflection of the seal 150 may vary from the deflection illustrated in FIGS. 4 and 5 depending on the configuration and relative positioning of the seats 134, 138, the material used for the seal 150, and the specific configuration of the weight 182.

Figure 5:
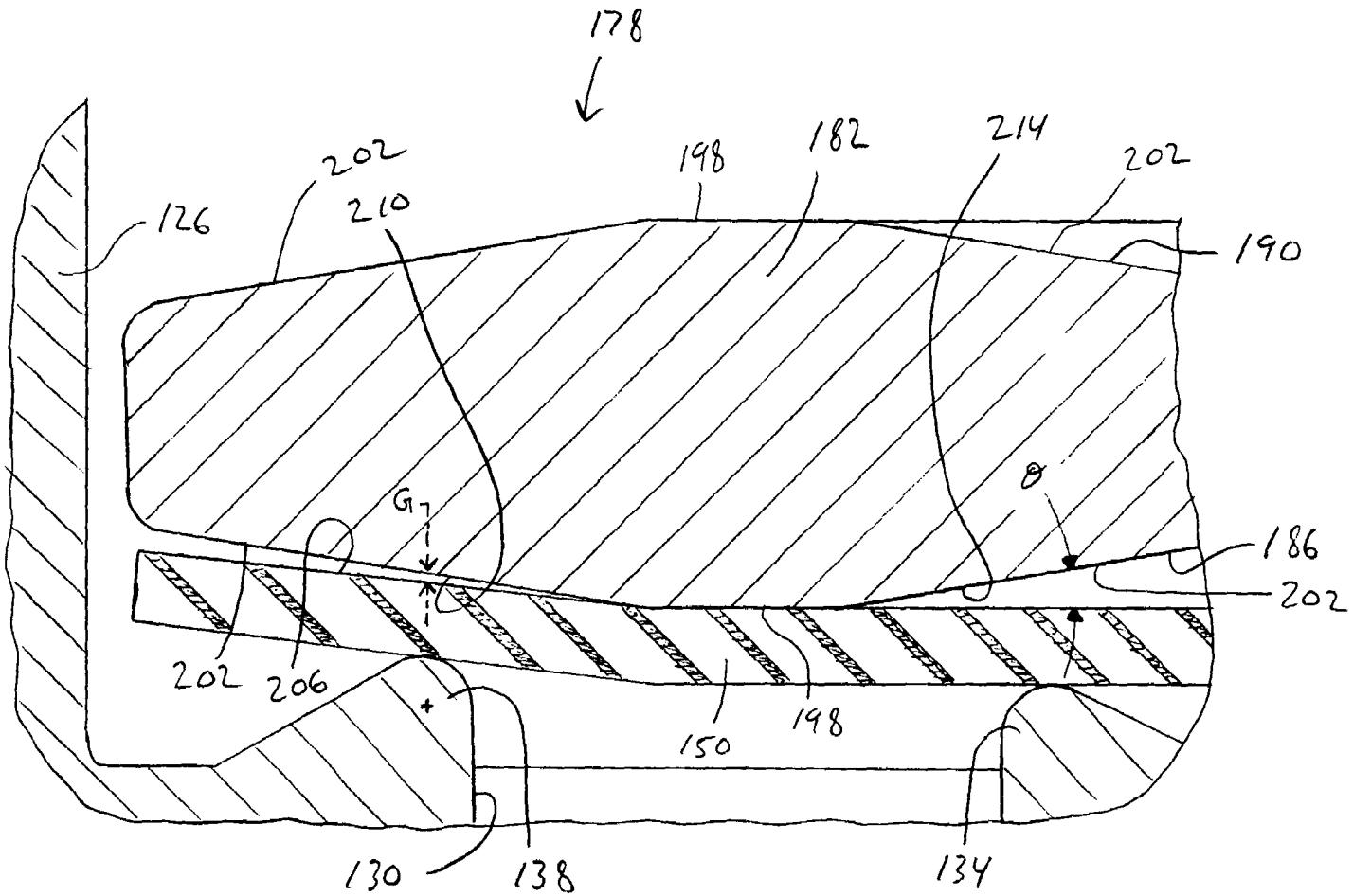
FIG. 5 is an enlarged view of FIG. 4, illustrating a gap defined by the discriminator valve assembly.

In the illustrated construction of FIGS. 4 and 5, the lower convex surface 186 of the weight 182 includes a substantially flat apex portion 198 as the apex of the lower convex surface 186 in contact with the seal 150. Substantially flat portions 202 on opposite sides of the apex portion 198 each extend at an angle toward the centerline 194, such that the three flat portions 198, 202 together define the lower convex surface 186. In alternative constructions of the weight (not shown), the lower convex surface can include more flat portions, can be substantially curved such that no portion of the lower convex surface is flat, or can include a combination of flat and curved surface portions. Additionally, the apex portion 198 of the lower convex surface 186 can have other configurations (e.g., curved) as long as the apex only contacts the seal 150 at a location between the inner and outer seats 134, 138. The weight 182 is illustrated as having substantially the same lower and upper convex surfaces 186, 190 so that the weight 182 cannot be improperly installed in the valve seat member 106. However, it is to be understood that the upper surface of the weight 182 need not have a convex profile.

The weight 182 is also configured to provide at least one gap between the lower convex surface 186 of the weight 182 and an upper surface 206 of the seal 150. As best illustrated in FIG. 5, a first or outer substantially annular wedge-shaped gap 210 is provided at a location radially outside the substantially flat apex portion 198 and adjacent the outer seat 138, and a second or inner substantially annular wedge-shaped gap 214 is provided radially inside of the substantially flat apex portion 198 and adjacent the inner seat 134.

The size and configuration of the gaps 210, 214 are determined in part by the shape of the weight 182, and more specifically, by a convex slope angle θ defined by the lower convex surface 186 relative to a substantially horizontal plane containing the contact interface between the substantially flat apex portion 198 and the upper surface 206 of the seal 150. As illustrated in FIG. 5, this plane contains the upper surface 206 of the seal 150, however, this need not always be the case. In some constructions of the weight 182, the convex slope angle θ may be at least about 3°. In yet other constructions of the weight 182, the convex slope angle θ may be no more than about 4°. In some constructions of the weight 182, the convex slope angle θ of the lower convex surface 186 may be in a range of about 2° to about 5°. Depending on the specific material used for the seal 150 and the specific configuration of the weight 182, convex slope angles θ in excess of about 5° may cause the seal 150 to become overstrained and wavy, thus risking potential leakage.

In addition to ensuring that contact between the weight 182 and the seal 150 occurs only at a location between the first and second seats 134, 138, the outer and inner gaps 210, 214 further facilitate proper sealing of the fuel passageways 130 by allowing fuel to move freely into the gaps 210, 214 when the fuel pump 58 is not active. As fuel is allowed to flow into the gaps 210, 214, the fuel pressure acts directly on portions of the seal 150 between and adjacent the inner and outer seats 134, 138. The added fuel pressure in the gaps 210, 214 helps to bias the seal 150 toward the seats 134, 138 and deflect the seal 150 so that it conforms with any height irregularities or waviness between the inner and outer seats 134, 138. In the illustrated construction, the portion of the outer gap 210 located directly adjacent (above, as viewed in FIG. 5) the outer seat 138 has a gap height G, defined as the distance between the flat portion 202 and the upper surface 206 of the seal 150, of at least about 0.01 mm. Gap heights less than about 0.01 mm may hinder or prevent fuel from flowing into the portion of the outer gap 210 that extends between the outer seat 138 and the substantially flat apex portion 198.

Figure 6:
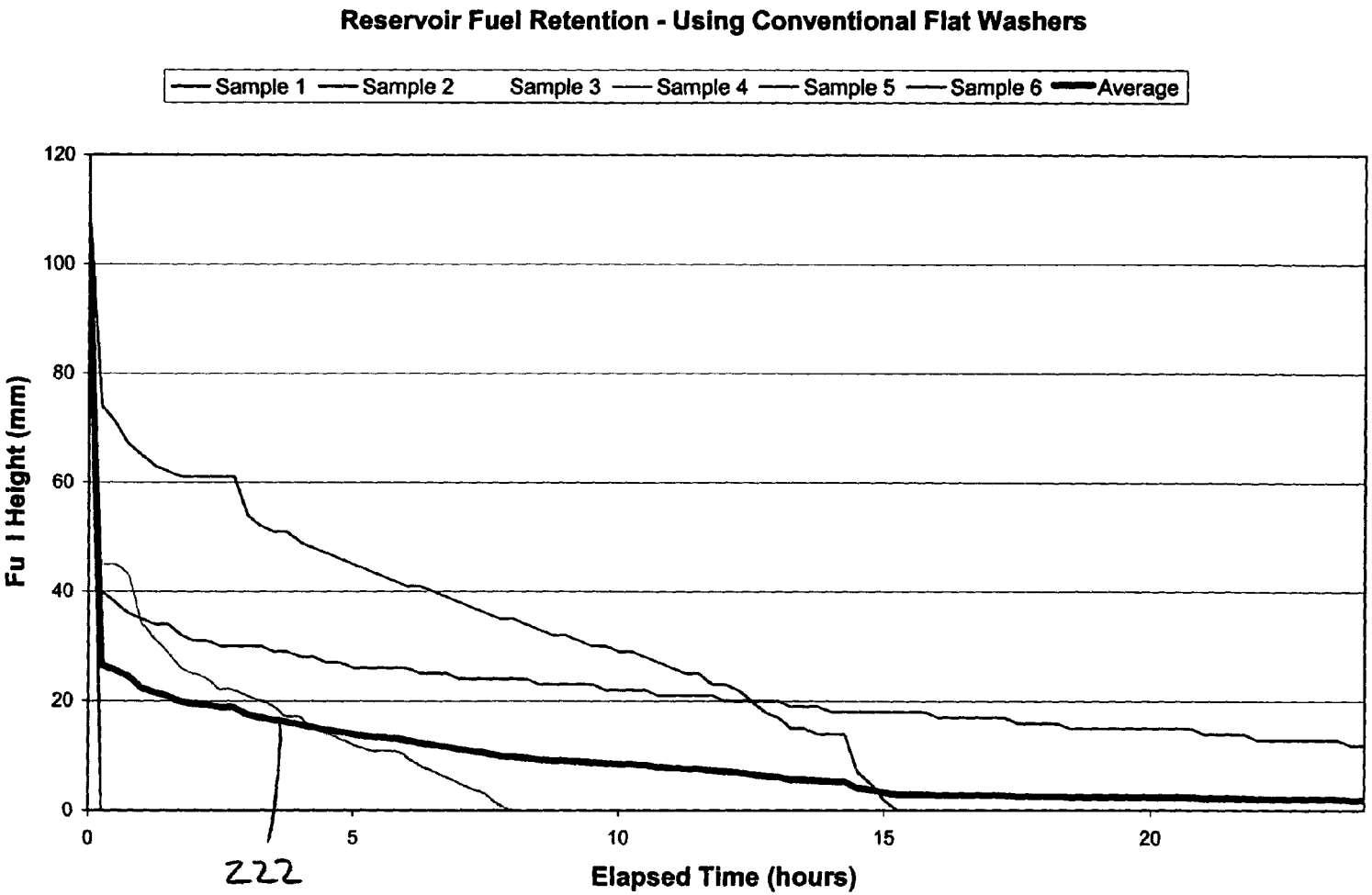
FIG. 6 is a graph illustrating fuel retention of a reservoir utilizing a conventional discriminator valve assembly.

FIG. 6 illustrates the results of multiple experimental trials designed to track the performance (i.e., the level of retained fuel in the reservoir) of a reservoir 34 utilizing the prior art discriminator valve assembly 170. For the trials, six sample reservoirs 34, with six corresponding prior art discriminator valve assemblies 170 therein, were filled to an initial height of fuel. After filling the reservoirs 34 with an initial height of fuel, the height of fuel retained by the reservoirs 34 was measured over a 24-hour period. As shown in FIG. 6, each sample reservoir 34 yielded different trend lines. Some of the sample reservoirs 34 retained more fuel for a longer period of time than others, while some of the sample reservoirs 34 emptied shortly after the beginning of the trials. Generally, as indicated by an average trend line 222 of the six sample reservoirs 34, the sample reservoirs 34 utilizing the prior art discriminator valve assemblies 170 lost a majority of their fuel shortly after the beginning of the test, after which time the rate of fuel loss somewhat decreased throughout the remainder of the 24-hour test period. On average, the initial height of fuel in the six sample reservoirs 34 was 102.2 mm. After the 24-hour test period, on average, the height of retained fuel in the six sample reservoirs 34 was 2.0 mm. This corresponds to a fuel height loss of 100.2 mm, or a loss of 98% of the initial level of fuel in the reservoirs 34.

Figure 7:
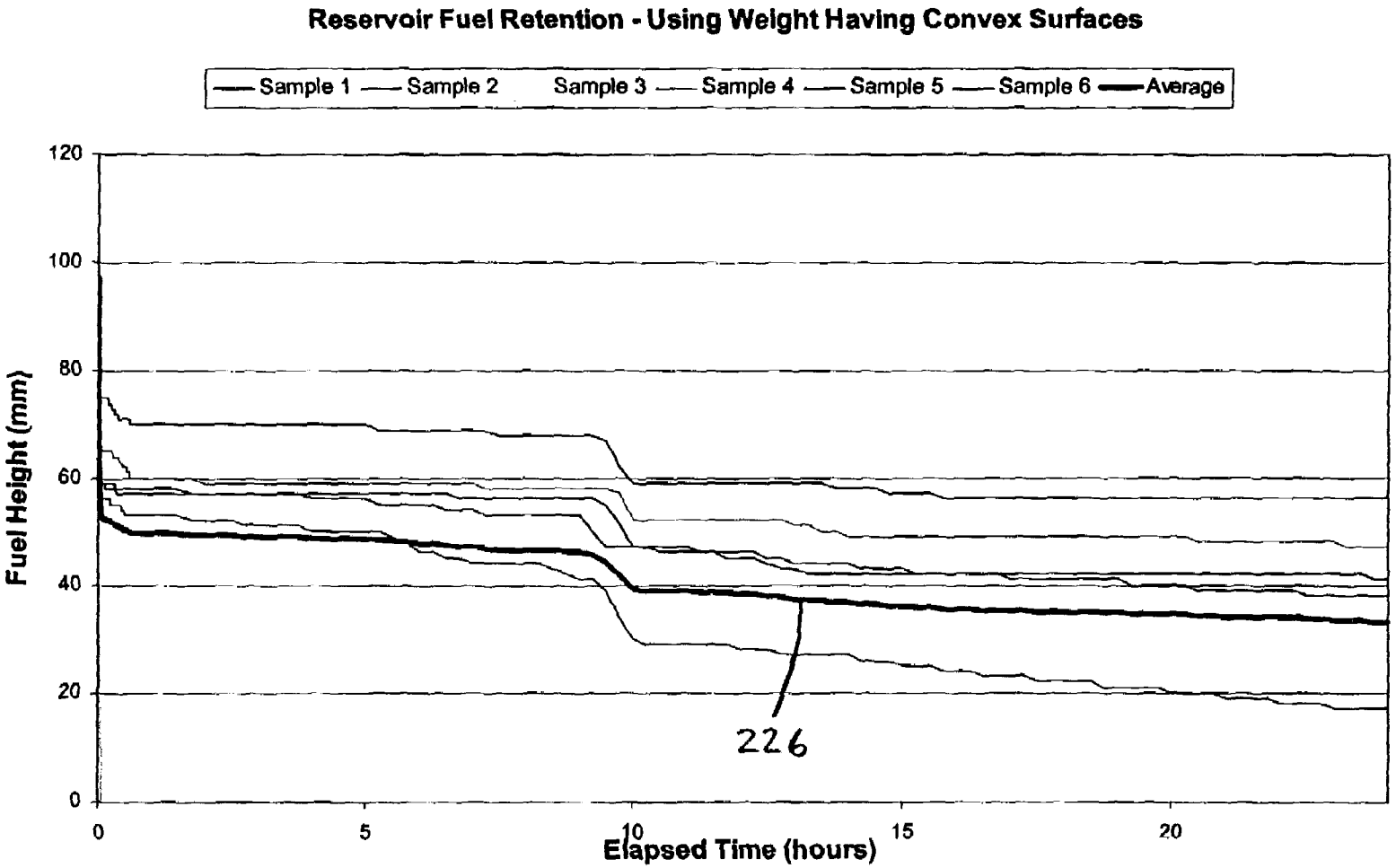
FIG. 7 is a graph illustrating fuel retention of a reservoir utilizing a discriminator valve assembly of the invention.

FIG. 7 illustrates the results of multiple experimental trials designed to track the performance (i.e., the level of retained fuel in the reservoir) of a reservoir 34 utilizing a discriminator valve assembly 178 of the invention. More specifically, the only difference between the trials of FIG. 7 and the trials of FIG. 6 is that the flat washer 158 of the prior art discriminator valve assembly 170 was replaced with the weight 182 having the substantially convex surfaces 186, 190.

Generally, as indicated by an average trend line 226 of the six sample reservoirs 34, the sample reservoirs 34 utilizing the weight 182 lost some of their fuel shortly after the beginning of the test, after which time the rate of fuel loss decreased substantially throughout the remainder of the 24-hour test period. On average, the initial height of fuel in the six sample reservoirs 34 was 97.2 mm. After the 24-hour test period, on average, the retained height of fuel in the six sample reservoirs 34 was 33.2 mm. This corresponds to a fuel height loss of 64 mm, or a loss of 66% of the initial level of fuel in the reservoirs. On average, the reservoirs 34 utilizing the weight 182 retained about 16.6 times the fuel retained by the reservoirs 34 utilizing the conventional flat washers 158.

Various features of the invention are set forth in the following claims.

I claim:

1. A fuel pump module comprising:

a reservoir configured to hold a supply of fuel, the reservoir including a fuel passageway and defining a first seat on a first side of the fuel passageway and a second seat on a second side of the fuel passageway;

a seal configured to be seated on the first and second seats to substantially seal the fuel passageway; and a weight biasing the seal toward the first and second seats by contacting the seal only at a location between the first and second seats;

wherein the weight deflects the seal in an area between the first and second seats to ensure that the seal contacts both the first and second seats to substantially seal the fuel passageway.

2. The fuel pump module of claim 1, wherein the first seat and the second seat are substantially annular.

3. The fuel pump module of claim 2, wherein the first seat and the second seat are concentric.

4. The fuel pump module of claim 1, wherein the seal is a substantially flat, annular disk made from a resilient material.

5. The fuel pump module of claim 1, wherein the weight includes a substantially convex surface at least partially in contact with the seal.

6. The fuel pump module of claim 5, wherein the substantially convex surface defines a convex slope angle of at least about 3°.

7. The fuel pump module of claim 5, wherein the substantially convex surface defines a convex slope angle of no more than about 4°.

8. The fuel pump module of claim 5, wherein the substantially convex surface defines a convex slope angle in a range of about 2° to about 5°.

9. The fuel pump module of claim 1, wherein the weight is substantially annular.

10. The fuel pump module of claim 1, wherein the weight is configured to provide a gap between a lower surface of the weight and an upper surface of the seal.

11. The fuel pump module of claim 10, wherein the gap includes a first gap located adjacent the first seat and a second gap located adjacent the second seat.

12. The fuel pump module of claim 10, wherein the gap between the lower surface of the weight and the upper surface of the seal is at least 0.01 mm at a location adjacent at least one of the first and second seats.

13. A fuel pump module, comprising:

a reservoir configured to hold a supply of fuel, the reservoir including a fuel passageway and defining a first seat on a first side of the fuel passageway and a second seat on a second side of the fuel passageway;

a seal configured to be at least partially seated on the first and second seats to substantially seal the fuel passageway; and a weight biasing the seal toward the first and second seats, the weight being configured to provide a gap between a lower surface of the weight and an upper surface of the seal.

14. The fuel pump module of claim 13 wherein the weight is configured to contact the seal only at a location between the first and second seats.

15. The fuel pump module of claim 13, wherein the first seat and the second seat are substantially annular.

16. The fuel pump module of claim 15, wherein the first seat and the second seat are concentric.

17. The fuel pump module of claim 13, wherein the seal is a substantially flat, annular disk made from a resilient material.

18. The fuel pump module of claim 13, wherein the weight includes a substantially convex surface at least partially in contact with the seal.

19. The fuel pump module of claim 18, wherein the substantially convex surface defines a convex slope angle of at least about 3°.

20. The fuel pump module of claim 18, wherein the substantially convex surface defines a convex slope angle of no more than about 4°.

21. The fuel pump module of claim 18, wherein the substantially convex surface defines a convex slope angle in a range of about 2° to about 5°.

22. The fuel pump module of claim 13, wherein the weight is substantially annular.

23. The fuel pump module of claim 13, wherein the gap includes a first gap locatedadjacent the first seat and a second gap located adjacent the second seat.

24. The fuel pump module of claim 13, wherein the gap between the lower surface of the weight and the upper surface of the seal is at least 0.01 mm at a location adjacent at least one of the first and second seats.

25. The fuel pump module of claim 13, wherein the weight deflects the seal in an area between the first and second seats to ensure that the seal contacts both the first and second seats to substantially seal the fuel passageway.

26. A method for maintaining fuel within a fuel pump module, the method comprising:

providing a reservoir having a fuel passageway and defining a first seat on a first side of the fuel passageway and a second seat on a second side of the fuel passageway;

biasing a seal toward the first and second seats; and deflecting the seal in an area between the first and second seats to ensure contact between the seal and the first seat, and the seal and the second seat to substantially seal the fuel passageway even when the first and second seats are not properly aligned.

27. A method for maintaining fuel within a fuel pump module, the method comprising:

providing a reservoir having a fuel passageway and defining a first seat on a first side of the fuel passageway and a second seat on a second side of the fuel passageway; and biasing a seal toward the first and second seats to substantially seal the fuel passageway even when the first and second seats are not properly aligned;

wherein biasing the seal toward the first and second seats includes positioning a weight on the seal, the weight being configured to provide a gap between a lower surface of the weight and an upper surface of the seal.

28. The method of claim 27, wherein providing a gap includes providing a first gap adjacent the first seat and providing a second gap adjacent the second seat.

29. The method of claim 27, further comprising allowing fuel to enter the gap to bias the seal toward the first and second seats.

30. A method for maintaining fuel within a fuel pump module, the method comprising:

providing a reservoir having a fuel passageway, the reservoir defining a first seat on a first side of the fuel passageway and a second seat on a second side of the fuel passageway;

biasing a seal toward the first and second seats using a weight;

providing a gap between a lower surface of the weight and an upper surface of the seal; and substantially sealing the fuel passageway by seating the seal upon the first and second seats.

31. The method of claim 30, further comprising applying the weight entirely to a portion of the seal between the first seat and the second seat.

32. The method of claim 30, wherein providing a gap includes providing a first gap adjacent the first seat and providing a second gap adjacent the second seat.

33. The method of claim 30, further comprising allowing fuel to enter the gap to bias the seal toward the first and second seats.

34. The method of claim 30, further comprising deflecting the seal in an area between the first and second seats with the weight to ensure contact between the seal and the first seat, and the seal and the second seat.

35. The method of claim 26, wherein biasing the seal toward the first and second seats includes positioning a weight on the seal, the weight being configured to provide a gap between a lower surface of the weight and an upper surface of the seal.

36. The method of claim 35, wherein providing a gap includes providing a first gap adjacent the first seat and providing a second gap adjacent the second seat.

37. The method of claim 37, further comprising allowing fuel to enter the gap to bias the seal toward the first and second seats.

38. A fuel pump module comprising:

a reservoir configured to hold a supply of fuel, the reservoir including a fuel passageway and defining a first seat on a first side of the fuel passageway and a second seat on a second side of the fuel passageway;

a seal configured to be seated on the first and second seats to substantially seal the fuel passageway; and a weight biasing the seal toward the first and second seats by contacting the seal only at a location between the first and second seats;

wherein the weight includes a substantially convex surface at least partially in contact with the seal.

* * * * *